US010153079B2

(12) United States Patent
Hashimoto et al.

(10) Patent No.: US 10,153,079 B2
(45) Date of Patent: Dec. 11, 2018

(54) LAMINATED COIL COMPONENT AND METHOD OF MANUFACTURING THE SAME

(71) Applicant: MURATA MANUFACTURING CO., LTD., Kyoto-fu (JP)

(72) Inventors: Hiroki Hashimoto, Nagaokakyo (JP); Masayuki Oishi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/611,993

(22) Filed: Jun. 2, 2017

(65) Prior Publication Data

US 2018/0019052 A1 Jan. 18, 2018

(30) Foreign Application Priority Data

Jul. 15, 2016 (JP) ..... 2016-140278

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/245* (2013.01); *H01F 41/041* (2013.01); *H01F 2027/2809* (2013.01)

(58) Field of Classification Search
USPC ..... 336/200, 232, 192, 234; 257/531
See application file for complete search history.

(56) References Cited

U.S. PATENT DOCUMENTS 7,579,937 B2 * 8/2009 Arata ..... H01F 17/0013 336/200
2003/0164533 A1 * 9/2003 Tada ..... H01F 5/003 257/531
(Continued)

FOREIGN PATENT DOCUMENTS

CN 102771199 A 11/2012
JP H11-219821 A 8/1999
(Continued)

OTHER PUBLICATIONS

An Office Action mailed by the Korean Patent Office dated Jul. 4, 2018, which corresponds to Korean Patent Application 10-2017-0079692 and is related to U.S. Appl. No. 15/611,993.

*Primary Examiner* — Elvin G Enad
*Assistant Examiner* — Kazi Hossain
(74) *Attorney, Agent, or Firm* — Studebaker & Brackett PC

(57) ABSTRACT

A laminated coil component is configured by laminating a plurality of magnetic layers and a plurality of coil conductors in a lamination direction. In a cross-section taken along a width direction of the coil conductors, each coil conductor has a first surface on one side in the lamination direction, a second surface on another side in the lamination direction, and side surfaces on both sides in the width direction. The second surface makes contact with the magnetic layer. A hollow cavity portion is formed between the magnetic layer, and the first surface and both side surfaces. The hollow cavity portion has a first extended portion, extending outward in a direction intersecting with the lamination direction, on the first surface side, on at least one of both end sides in the width direction.

6 Claims, 14 Drawing Sheets

(51) Int. Cl.
*H01F 27/245* (2006.01)
*H01F 41/04* (2006.01)

(56) References Cited

U.S. PATENT DOCUMENTS

| | | | | |
|---|---|---|---|---|
| 2011/0133881 | A1* | 6/2011 | Nakajima | H01F 3/14 336/200 |
| 2012/0326827 | A1 | 12/2012 | Nanjyo et al. | |

FOREIGN PATENT DOCUMENTS

| | | | |
|---|---|---|---|
| JP | 2004-079994 | A | 3/2004 |
| JP | 2005-159301 | A | 6/2005 |
| JP | 2006-066764 | A | 3/2006 |
| JP | 2014-078650 | A | 5/2014 |
| JP | 2014-082280 | A | 5/2014 |
| JP | 2015-191904 | A | 11/2015 |
| KR | 10-2013-0098905 | A | 9/2013 |
| KR | 10-2015-0080715 | A | 7/2015 |

* cited by examiner

LAMINATED COIL COMPONENT AND METHOD OF MANUFACTURING THE SAME

CROSS REFERENCE TO RELATED APPLICATIONS

This application claims benefit of priority to Japanese Patent Application 2016-140278 filed Jul. 15, 2016, the entire content of which is incorporated herein by reference.

TECHNICAL FIELD

The present disclosure relates to a laminated coil component and a method of manufacturing the same.

BACKGROUND

The laminated coil component disclosed in Japanese Unexamined Patent Application Publication No. 2006-66764 is known as an existing example of a laminated coil component. This laminated coil component is configured by laminating a plurality of magnetic layers and a plurality of coil conductors in a lamination direction. In a cross-section taken along a width direction of the coil conductors, a lower surface of each coil conductor makes contact with a magnetic layer, and a hollow cavity portion is formed between a magnetic layer, and an upper surface and both width direction side surfaces of the coil conductor.

The presence of this hollow cavity portion makes it possible to suppress stress on the magnetic layers caused by changes in the temperature of the coil conductors, which are caused by a difference in the thermal expansion coefficients of the coil conductors and the magnetic layers. As a result, deterioration of inductance and impedance characteristics caused by internal stress can be eliminated.

Incidentally, diligent examinations of the above-described laminated coil component indicated that small-loop magnetic fluxes are produced in the periphery of the individual coil conductors. The small-loop magnetic fluxes overlap with large-loop magnetic fluxes produced by multiple coil conductors and passing through the centers of the coil conductors, which was found to influence the inductance.

SUMMARY

Accordingly, it is an object of the present disclosure to provide a laminated coil component capable of reducing the influence on inductance by reducing the overlapping of small-loop magnetic fluxes on large-loop magnetic fluxes, as well as a method of manufacturing the same.

In order to solve the problem, a laminated coil component according to a preferred embodiment of the present disclosure is a laminated coil component including a plurality of magnetic layers and a plurality of coil conductors laminated in a lamination direction. In a cross-section taken along a width direction of the coil conductors, each of the coil conductors has a first surface on one side in the lamination direction, a second surface on another side in the lamination direction, and side surfaces on both sides in the width direction. The second surface makes contact with the magnetic layer. A hollow cavity portion is formed between the magnetic layer, and the first surface and both the side surfaces. The hollow cavity portion has a first extended portion, extending outward in a direction intersecting with the lamination direction, on the first surface side, on at least one of both end sides in the width direction.

According to this embodiment, the hollow cavity portion has the first extended portion, extending outward in the direction intersecting with the lamination direction, on the first surface side, on at least one of both end sides in the width direction. Accordingly, the first extended portion can block magnetic fluxes (small-loop magnetic fluxes) arising in the periphery of individual coil conductors. As such, a situation where the small-loop magnetic fluxes overlap with a magnetic flux (a large-loop magnetic flux) produced by a plurality of the coil conductors and passing through the centers of the plurality of the coil conductors can be reduced, and influence on inductance can in turn be reduced.

Additionally, according to a preferred embodiment of the laminated coil component, in the cross-section taken along the width direction of the coil conductor, a base end of the first extended portion is located further inward than a maximum width of the coil conductor.

According to this embodiment, the base end of the first extended portion is located further inward than the maximum width of the coil conductor, and thus a situation in which the first extended portion expands outward in the width direction of the coil conductor can be reduced. Accordingly, a situation where the large-loop magnetic flux is blocked by the first extended portion can be reduced.

Additionally, according to a preferred embodiment of the laminated coil component, in the cross-section taken along the width direction of the coil conductor, a leading end of the first extended portion is located further inward than a maximum width of the coil conductor.

According to this embodiment, the leading end of the first extended portion is located further inward than the maximum width of the coil conductor, and thus a situation in which the first extended portion expands outward in the width direction of the coil conductor can be suppressed. Accordingly, the first extended portion does not interfere with the large-loop magnetic flux.

Additionally, according to a preferred embodiment of the laminated coil component, in the cross-section taken along the width direction of the coil conductor, the first extended portion is located on the first surface side, on both end sides in the width direction.

According to this embodiment, the first extended portion is located on the first surface side, on both end sides in the width direction. As such, the small-loop magnetic fluxes can be blocked further, and a situation in which the small-loop magnetic fluxes overlap with the large-loop magnetic flux can be reduced further.

Additionally, according to a preferred embodiment of the laminated coil component, in the cross-section taken along the width direction of the coil conductor, the hollow cavity portion has a second extended portion, extending outward in a direction intersecting with the lamination direction, on the second surface side, on at least one of both end sides in the width direction.

According to this embodiment, the hollow cavity portion has the second extended portion, extending outward in the direction intersecting with the lamination direction, on the second surface side, on at least one of both end sides in the width direction. Accordingly, the second extended portion can block the small-loop magnetic fluxes. The small-loop magnetic fluxes overlapping with the large-loop magnetic flux can thus be further reduced, and thus the influence on the inductance can be further reduced as well.

Additionally, according to a preferred embodiment of the laminated coil component, in the cross-section taken along the width direction of the coil conductor, the second extended portion is located on the second surface side, on both end sides in the width direction.

According to this embodiment, the second extended portion is located on the second surface side, on both end sides in the width direction. As such, the small-loop magnetic fluxes can be blocked further, and a situation in which the small-loop magnetic fluxes overlap with the large-loop magnetic flux can be reduced further.

A method of manufacturing a laminated coil component according to a preferred embodiment includes the steps of: laminating a coil conductor on a first magnetic layer; laminating a first burn-off material on at least part of a first surface which is an upper surface of the coil conductor, and on both side surfaces of the coil conductor in a width direction of the coil conductor; laminating a second magnetic layer on the first magnetic layer such that the second magnetic layer does not overlap with a first region on the first surface side of the coil conductor but does overlap with a second region on both the side surface sides of the coil conductor; laminating a second burn-off material on the first region on the first surface side of the coil conductor and on part of the second magnetic layer such that the second burn-off material is broader than a width of the first region on the first surface side of the coil conductor exposed from the second magnetic layer; laminating a third magnetic layer on the second magnetic layer so as to overlap with the second burn-off material; and burning off the first burn-off material and the second burn-off material through firing.

According to this embodiment, the first burn-off material is laminated on at least part of the first surface of the coil conductor and on both side surfaces of the coil conductor; the second magnetic layer is laminated on the first magnetic layer such that the second magnetic layer does not overlap with the first region on the first surface side of the coil conductor but does overlap with the second region on both the side surface sides of the coil conductor; the second burn-off material is laminated such that the second burn-off material is broader than a width of the first region on the first surface side of the coil conductor exposed from the second magnetic layer; the third magnetic layer is laminated on the second magnetic layer so as to overlap with the second burn-off material; and the first burn-off material and the second burn-off material are burned off through firing.

Accordingly, a part corresponding to the first burn-off material and the second burn-off material serves as the hollow cavity portion. In other words, the hollow cavity portion is formed between the first surface and both side surfaces of the coil conductor and the second and third magnetic layers. The hollow cavity portion has the first extended portion, extending in a direction intersecting with the lamination direction, on the first surface side, on at least one of both end sides in the width direction.

Additionally, according to a preferred embodiment of the method of manufacturing the laminated coil component, in the step of laminating the first burn-off material, the first burn-off material is laminated on the entire first surface and both the side surfaces of the coil conductor.

According to this embodiment, the first burn-off material is laminated on the entire first surface of the coil conductor. As such, upon the second magnetic layer drying in the subsequent step of laminating the second magnetic layer, there is a risk that the first burn-off material will be pulled by the second magnetic layer, producing fissures in the first burn-off material. However, the second burn-off material is laminated on the first burn-off material thereafter. The second burn-off material thus enters into the fissures in the first burn-off material. As such, in the subsequent step of laminating the third magnetic layer, the third magnetic layer can be prevented from entering into the fissures in the first burn-off material. A situation where the coil conductor and the third magnetic layer make contact can thus be avoided, and the occurrence of stress can be suppressed.

Additionally, according to a preferred embodiment of the method of manufacturing the laminated coil component, the following steps are repeated in order a plurality of times: the step of laminating the coil conductor; the step of laminating the first burn-off material; and the step of laminating the second magnetic layer. The step of laminating the second burn-off material is then carried out.

According to this embodiment, the step of laminating the coil conductor, the step of laminating the first burn-off material, and the step of laminating the second magnetic layer are repeated multiple times, and thus thick-film coil conductors can be formed.

Additionally, according to a preferred embodiment of the method of manufacturing the laminated coil component, the step of laminating the coil conductor is carried out once or a plurality of times; the step of laminating the first burn-off material is then carried out; the step of laminating the second magnetic layer is carried out once or a plurality of times; and the step of laminating the second burn-off material is then carried out.

According to this embodiment, the step of laminating the coil conductor is carried out once or repeated multiple times, and the step of laminating the first burn-off material is then carried out. Then, the step of laminating the second magnetic layer is carried out once or repeated multiple times. Accordingly, thick-film coil conductors can be formed.

With the laminated coil component and the method of manufacturing the same according to the present disclosure, the hollow cavity portion has the first extended portion, extending in the direction intersecting with the lamination direction, on the first surface side, on at least one of both end sides in the width direction. Accordingly, small-loop magnetic fluxes overlapping with the large-loop magnetic flux can be reduced, and thus the influence on inductance can be reduced as well.

Other features, elements, characteristics and advantages of the present disclosure will become more apparent from the following detailed description of preferred embodiments of the present disclosure with reference to the attached drawings.

DETAILED DESCRIPTION

Figure 1:
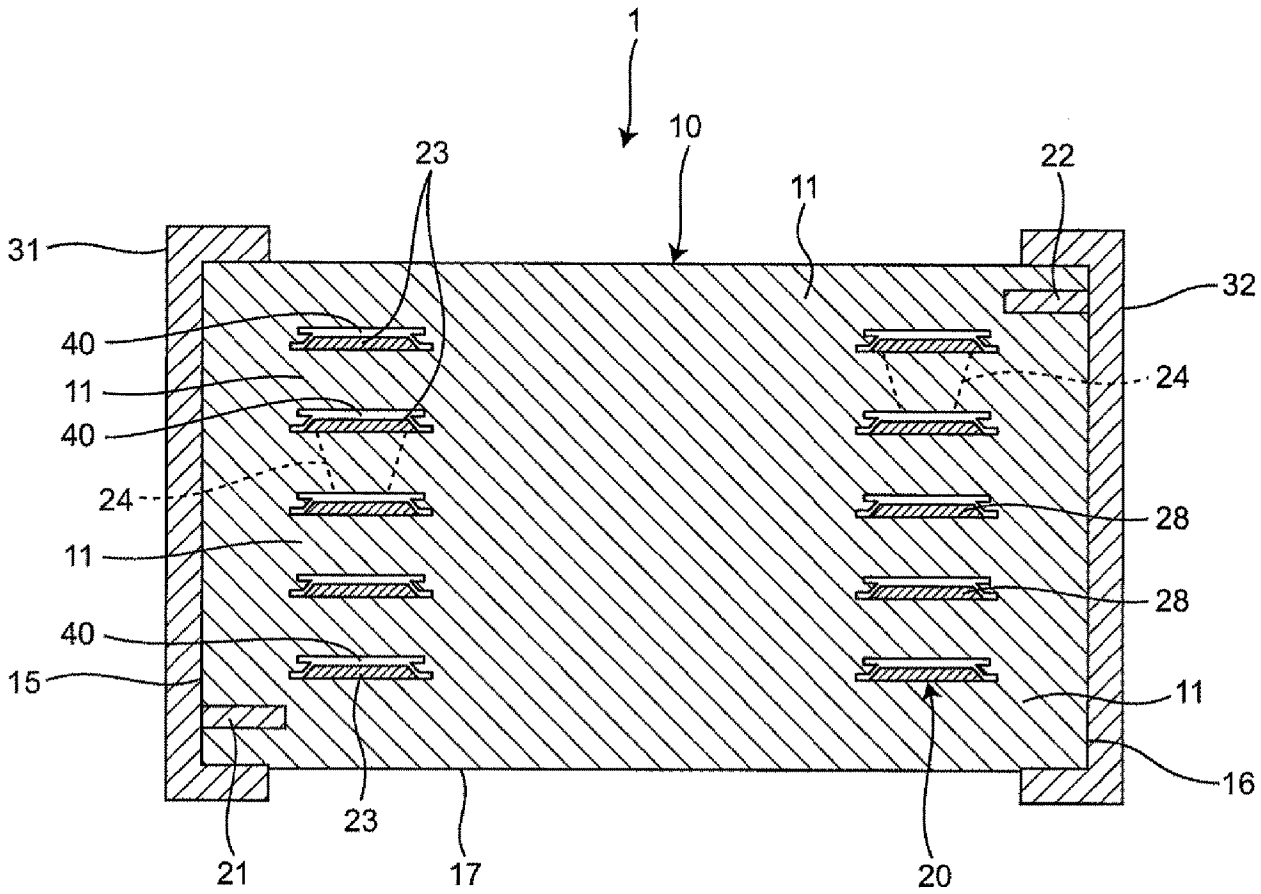
FIG. 1 is a cross-sectional view of a first embodiment of a laminated coil component.

The present disclosure will now be described in detail according to the embodiments illustrated in the drawings.

First Embodiment

Figure 2:
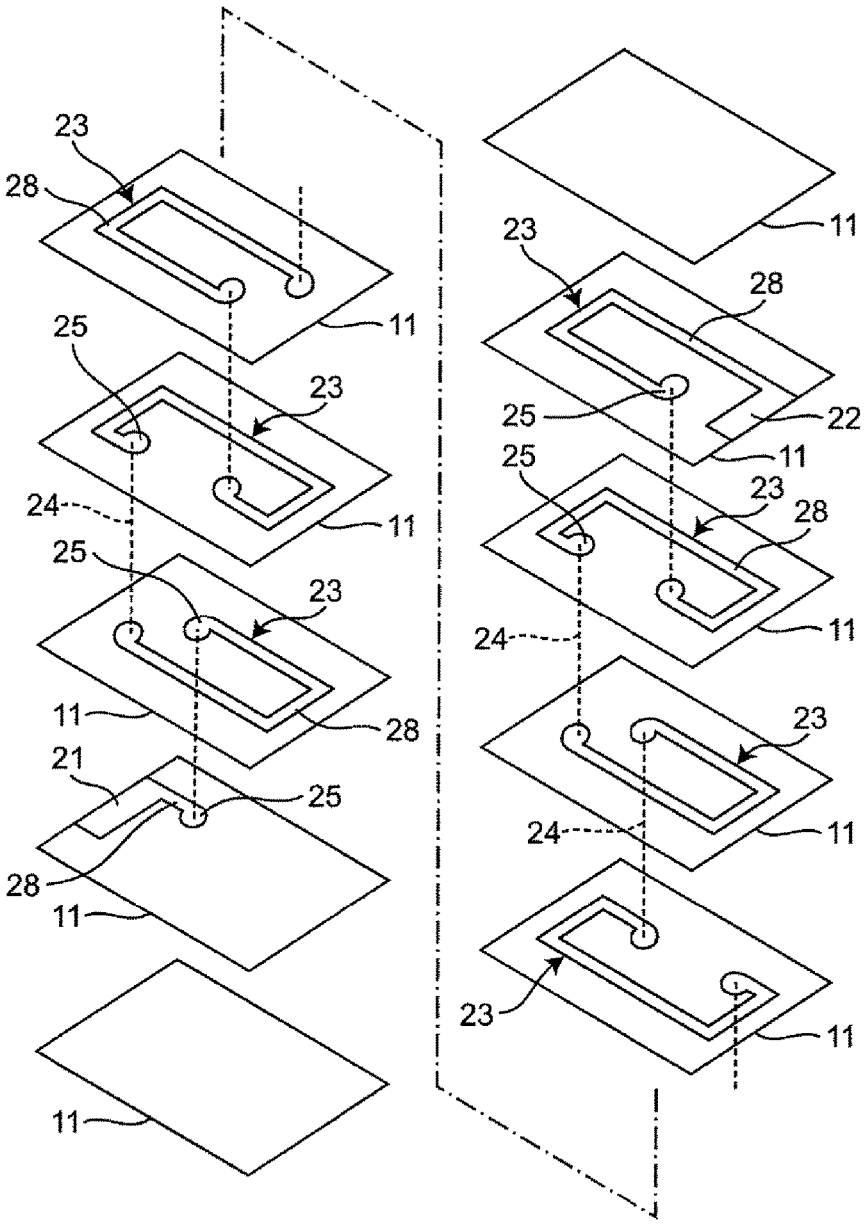
FIG. 2 is an exploded perspective view of the laminated coil component.

FIG. 1 is a cross-sectional view of a laminated coil component according to a first embodiment. FIG. 2 is an exploded perspective view of the laminated coil component. As illustrated in FIGS. 1 and 2, a laminated coil component 1 includes an element housing 10, a substantially spiral coil 20 provided within the element housing 10, and first and second outer electrodes 31 and 32 that are provided on surfaces of the element housing 10 and electrically connected to the coil 20.

The laminated coil component 1 is electrically connected to wires of a circuit board (not illustrated) through the first and second outer electrodes 31 and 32. The laminated coil component 1 is used as a noise removal filter, for example, and is used in electronic devices such as personal computers, DVD players, digital cameras, TVs, cellular phones, and car electronics.

The element housing 10 is formed by laminating a plurality of magnetic layers 11 together. The magnetic layers 11 are formed from a magnetic body such as a ferrite, for example. The element housing 10 is formed having a substantially rectangular parallelepiped shape. Surfaces of the element housing 10 include a first end surface 15, a second end surface 16 located on the side opposite from the first end surface 15, and a peripheral surface 17 located between the first end surface 15 and the second end surface 16. The first end surface 15 and the second end surface 16 oppose each other in a direction orthogonal to a lamination direction of the magnetic layers 11.

The first outer electrode 31 covers the entire first end surface 15 of the element housing 10, as well as end portions of the peripheral surface 17 of the element housing 10 on the first end surface 15 side thereof. The second outer electrode 32 covers the entire second end surface 16 of the element housing 10, as well as end portions of the peripheral surface 17 of the element housing 10 on the second end surface 16 side thereof.

The coil 20 is formed from a conductive material such as Ag or Cu, for example. The coil 20 is wound into a substantially spiral shape along the lamination direction. A first extended conductor 21 and a second extended conductor 22 are provided on opposite ends of the coil 20.

The first extended conductor 21 is exposed from the first end surface 15 of the element housing 10 and makes contact with the first outer electrode 31, and the coil 20 is electrically connected to the first outer electrode 31 through the first extended conductor 21. The second extended conductor 22 is exposed from the second end surface 16 of the element housing 10 and makes contact with the second outer electrode 32, and the coil 20 is electrically connected to the second outer electrode 32 through the second extended conductor 22.

The coil 20 includes coil conductors 23 formed on upper surfaces of corresponding magnetic layers 11, and via conductors 24 disposed passing through the magnetic layers 11 in a thickness direction thereof. Each of the coil conductors 23 includes a line portion 28 and a land portion 25 provided at an end portion of the line portion 28. The via conductors 24 connect land portions 25 that are adjacent in the lamination direction. In this manner, the land portions 25 of a plurality of coil conductors 23 are connected by via conductors 24 so as to form the substantially spiral coil 20. In other words, the coil conductors 23 are electrically connected in series to each other so as to form a substantially spiral shape. When viewed from the lamination direction, the plurality of line portions 28 overlap partially, with the coil conductors 23 forming a substantially rectangular annular shape as a whole. In the case where the magnetic layers 11 and the coil conductors 23 are produced through a method of printing and drying a paste, the coil conductors 23 can be directly connected to each other, and thus the via conductors 24 are not absolutely necessary.

Figure 3:
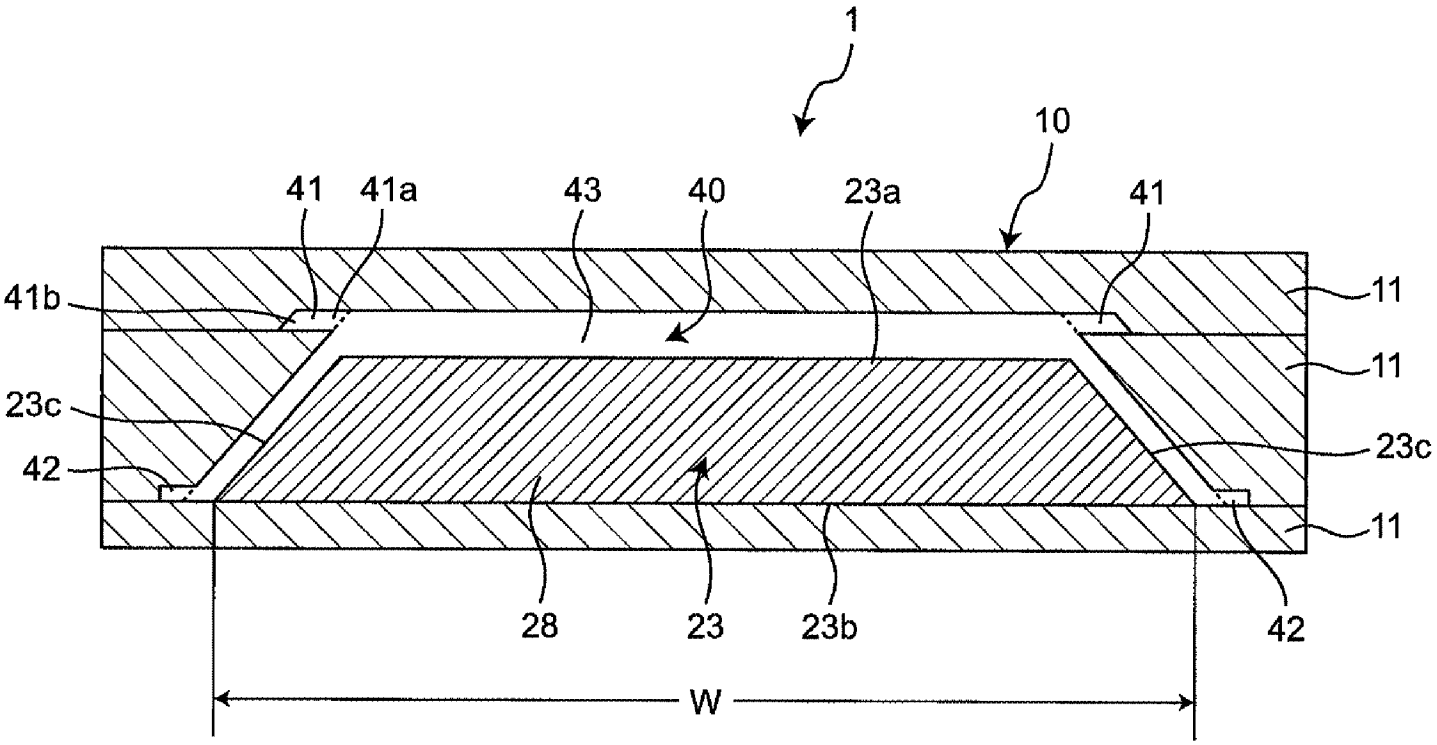
FIG. 3 is an enlarged cross-sectional view of the periphery of a coil conductor in the laminated coil component.

FIG. 3 is an enlarged cross-sectional view of the periphery of a coil conductor 23 in the laminated coil component 1. FIG. 3 illustrates a cross-section taken along a width direction of the coil conductors 23, or to rephrase, illustrates a cross-section orthogonal to an extension direction of the coil conductors 23 (the line portions 28).

As illustrated in FIG. 3, in the cross-section taken along the width direction of the coil conductor 23, the coil conductor 23 includes a first surface 23*a* on one side in the lamination direction, a second surface 23*b* on another side in the lamination direction, and side surfaces 23*c* and 23*c* on both sides in the width direction between the first surface 23*a* and the second surface 23*b*. The first surface 23*a* is an upper surface, whereas the second surface 23*b* is a lower surface. The first surface 23*a* is shorter than the second surface 23*b*, and has a substantially trapezoidal cross-sectional shape when taken along the width direction of the coil conductors 23.

The second surface 23*b* makes contact with the magnetic layer 11. The first surface 23*a* and both side surfaces 23*c* and 23*c* form a hollow cavity portion 40 with the magnetic layers 11.

The hollow cavity portion 40 has a main portion 43, and a first extended portion 41 and a second extended portion 42 connected to the main portion 43. The main portion 43 has a shape conforming to the first surface 23*a* and both the side surfaces 23*c* and 23*c*. To facilitate understanding, boundaries between the main portion 43 and the first and second extended portions 41 and 42 are indicated by broken lines.

The first extended portion 41 is provided on the first surface 23*a* side, on both end sides in the width direction. The first extended portion 41 extends toward the outer side in the width direction, which is orthogonal to the lamination direction. Note that the first extended portion 41 may extend toward the outer side relative to the center of the coil conductors 23, in a direction not orthogonal to but intersecting with the lamination direction.

The second extended portion 42 is provided on the second surface 23*b* side, on both end sides in the width direction. The second extended portion 42 extends toward the outer side in the width direction, which is orthogonal to the lamination direction. Note that the second extended portion 42 may extend toward the outer side relative to the center of the coil conductors 23, in a direction not orthogonal to but intersecting with the lamination direction.

A base end 41*a* of the first extended portion 41 is located further inward than a maximum width W of the coil conductor 23. A leading end 41*b* of the first extended portion 41 is located further inward than the maximum width W of the coil conductor 23. The base end 41*a* is located on the side connected to the main portion 43, whereas the leading end 41*b* is located on the outer side in the width direction. The maximum width W corresponds to the width of the second surface 23*b* of the coil conductor 23. Although the maximum width W corresponds to the width of the second surface 23*b* of the coil conductor 23 in the present embodiment, the maximum width W is not necessarily limited thereto. In other words, the maximum width W of the coil conductor 23 need not correspond to the location of the second surface 23*b* of the coil conductor 23.

Figure 4:
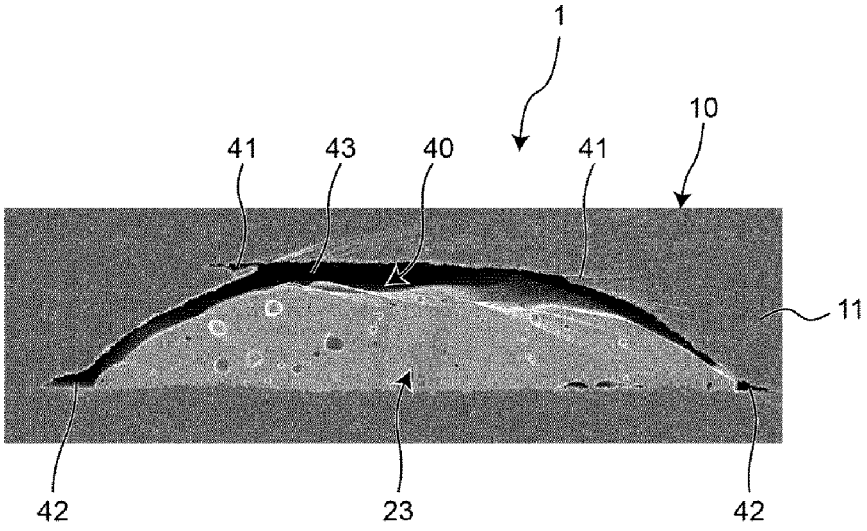
FIG. 4 is a diagram illustrating an image corresponding to FIG. 3.

FIG. 4 is a diagram illustrating an image corresponding to FIG. 3, and is a diagram illustrating an image taken by a scanning electron microscope. As illustrated in FIG. 4, the first and second extended portions 41 and 42 of the hollow cavity portion 40 extend outward in the width direction.

A shape of the first extended portion 41 as seen from the lamination direction will be described. The first extended portion 41 may be provided continuously or intermittently along the extension direction of the coil conductor 23 (the line portion 28). Additionally, the width of the first extended portion 41 may be uniform or non-uniform along the extension direction of the coil conductor 23. Furthermore, the shape of the leading end 41*b* of the first extended portion 41 may be a straight line following a side surface of the coil conductor 23, or may be tilted relative to the side surface of the coil conductor 23, or may be a curve. Note that the same applies to the second extended portion 42 as the first extended portion 41.

Figure 5:
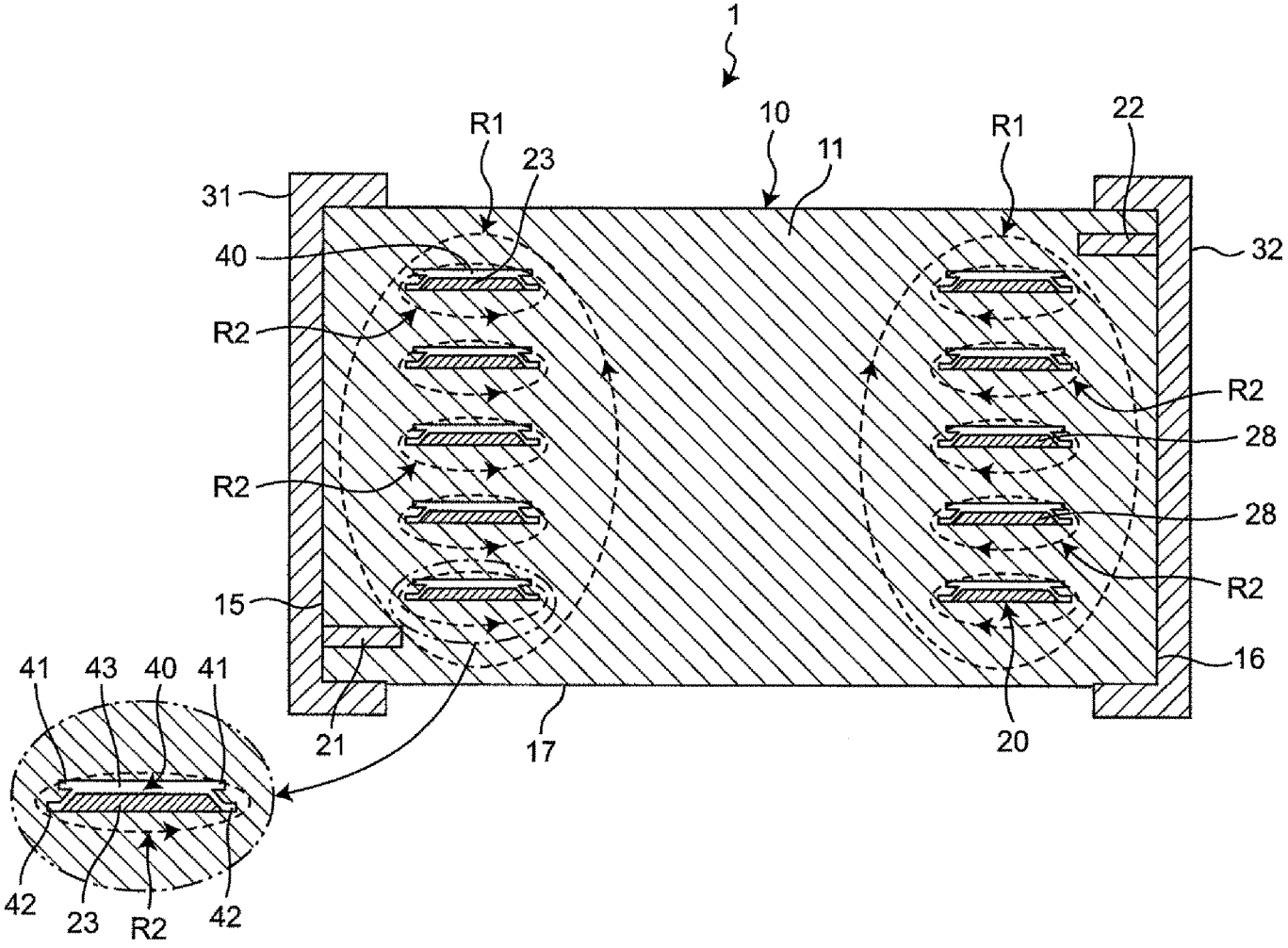
FIG. 5 is a descriptive diagram illustrating magnetic fluxes of the coil conductors.

As illustrated in FIG. 5, according to the laminated coil component 1 described in the present embodiment, the hollow cavity portion 40 includes the first extended portion 41. The first extended portion 41 can block a magnetic flux (a small-loop magnetic flux R2) produced in the periphery of a single coil conductor 23. Accordingly, a situation where the small-loop magnetic flux R2 overlaps with a magnetic flux (a large-loop magnetic flux R1) produced by a plurality of the coil conductors 23 and passing through the centers of the plurality of the coil conductors 23 can be reduced, and influence on inductance can in turn be reduced.

Additionally, the first extended portion 41 does not extend in the lamination direction, and thus coil conductors 23 and 23 adjacent in the lamination direction do not short through the first extended portion 41. To describe this in more detail, in the case where the first extended portion 41 extends in the lamination direction, and the material of the coil conductors 23 (silver, for example) has undergone electrochemical migration, it is possible that the material will cause shorting to occur between the coil conductors 23 and 23 through the first extended portion 41. However, the laminated coil component 1 according to the present embodiment can suppress such shorting.

Furthermore, the hollow cavity portion 40 includes the second extended portion 42, and the second extended portion 42 can block the small-loop magnetic flux R2. The small-loop magnetic flux R2 overlapping with the large-loop magnetic flux R1 can thus be further reduced, and thus the influence on the inductance can be further reduced as well.

Additionally, the first extended portion 41 is provided on the first surface 23*a* side, on both end sides in the width direction, and the second extended portion 42 is provided on the second surface 23*b* side, on both end sides in the width direction. As such, the small-loop magnetic flux R2 can be blocked even further, and the small-loop magnetic flux R2 overlapping with the large-loop magnetic flux R1 can be reduced even further as a result.

Furthermore, the base end 41*a* of the first extended portion 41 is located further inward than the maximum width W of the coil conductor 23, and the leading end 41*b* of the first extended portion 41 is located further inward than the maximum width W of the coil conductor 23. A situation where the first extended portion 41 expands outward in the width direction of the coil conductor 23 can therefore be suppressed. Accordingly, the first extended portion 41 does not interfere with the large-loop magnetic flux R1.

Note that the base end 41*a* may be located further inward than the maximum width W, and the leading end 41*b* may be located further outward than the maximum width W. A situation where the first extended portion 41 expands outward in the width direction of the coil conductor 23 can therefore be reduced. Accordingly, a situation where the large-loop magnetic flux R1 is blocked by the first extended portion 41 can be reduced.

Additionally, the first surface 23*a* and the side surfaces 23*c* may partially make contact with the magnetic layers 11, and the second surface 23*b* may be partially separated from the magnetic layers 11 so as to form the hollow cavity portion 40.

Next, a method of manufacturing the laminated coil component 1 will be described.

Figure 6A:
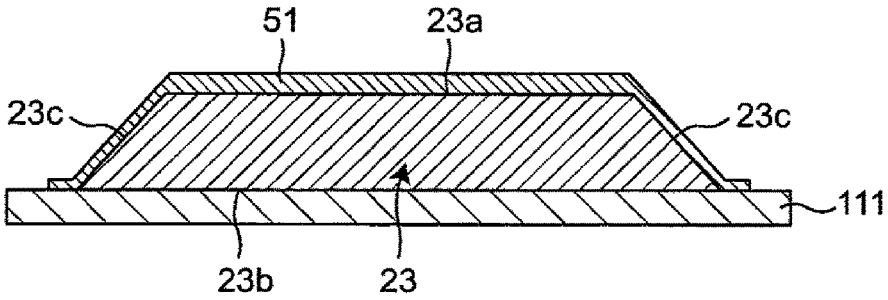
FIG. 6A is a descriptive diagram illustrating a first embodiment of a method of manufacturing the laminated coil component.

As illustrated in FIG. 6A, a coil conductor 23 is laminated upon part of a first magnetic layer 111. Then, a first burn-off material 51 is laminated onto the entire first surface 23*a*, which corresponds to the upper surface of the coil conductor 23, as well as the side surfaces 23*c* and 23*c* on both sides of the coil conductor 23 in the width direction. The first burn-off material 51 extends outward in the width direction at the second surface 23*b*, which corresponds to the lower surface of the coil conductor 23. The first burn-off material 51 is formed from a material that burns off through firing, and is formed from a resin material, for example.

Figure 6B:
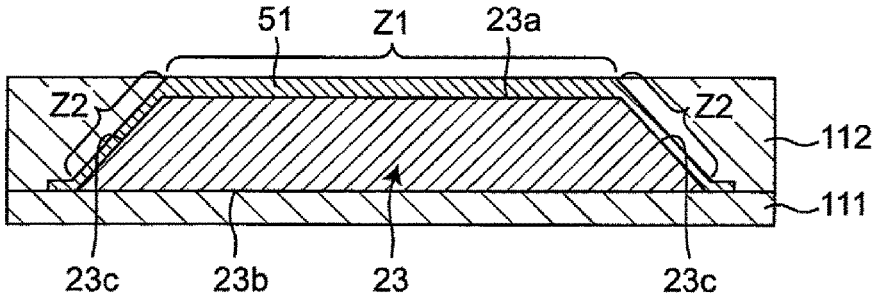
FIG. 6B is a descriptive diagram illustrating a first embodiment of a method of manufacturing the laminated coil component.

As illustrated in FIG. 6B, a second magnetic layer 112 is laminated onto the first magnetic layer 111 so as to overlap with second regions Z2 on the sides of both side surfaces 23*c* and 23*c*, without overlapping with a first region Z1 on the first surface 23*a* side of the coil conductor 23.

Figure 6C:
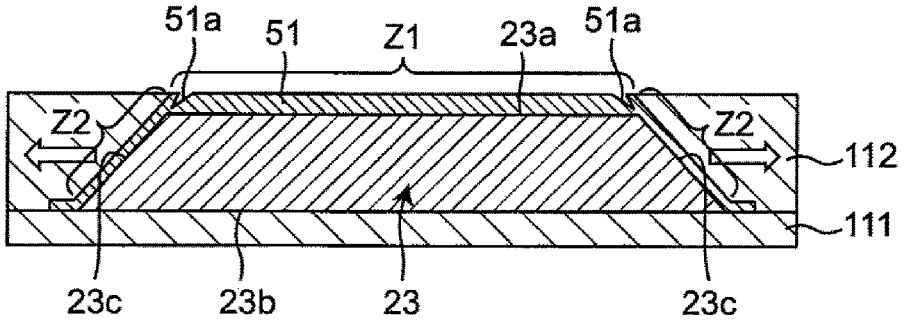
FIG. 6C is a descriptive diagram illustrating a first embodiment of a method of manufacturing the laminated coil component.

As illustrated in FIG. 6C, upon the second magnetic layer 112 drying, the first burn-off material 51 is laminated onto the entire first surface 23*a* of the coil conductor 23, and therefore there is a risk that the first burn-off material 51 will be pulled by the second magnetic layer 112 in the directions indicated by the arrows, producing fissures 51*a* in the first burn-off material 51.

Figure 6D:
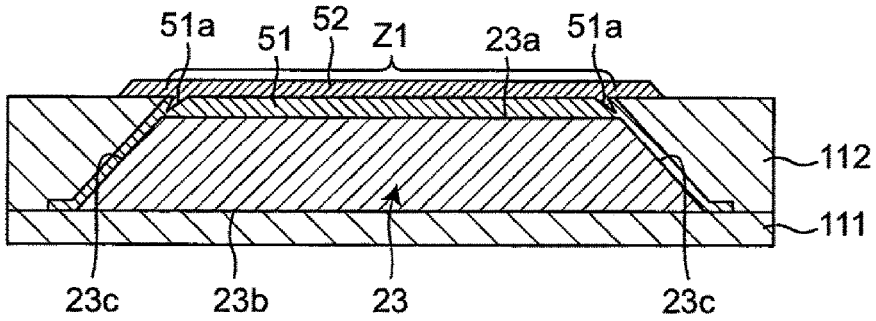
FIG. 6D is a descriptive diagram illustrating a first embodiment of a method of manufacturing the laminated coil component.

As illustrated in FIG. 6D, a second burn-off material 52 is laminated on the first region Z1 and parts of the second magnetic layer 112 on the first surface 23*a* side of the coil conductor 23, so as to be greater than the width of the first region Z1 on the first surface 23*a* side of the coil conductor 23 exposed from the second magnetic layer 112. In other words, the second burn-off material 52 extends further outward in the width direction than the first region Z1. Here, the second burn-off material 52 enters into the fissures in the first burn-off material 51. The material of the second burn-off material 52 is the same as the material of the first burn-off material 51. Note that the first burn-off material 51 and the second burn-off material 52 need not absolutely be formed from the same material.

Figure 6E:
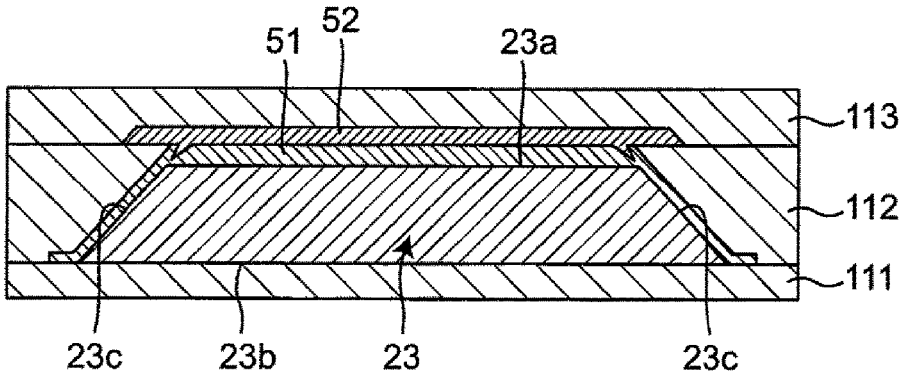
FIG. 6E is a descriptive diagram illustrating a first embodiment of a method of manufacturing the laminated coil component.

As illustrated in FIG. 6E, a third magnetic layer 113 is laminated onto the second magnetic layer 112 so as to overlap with the second burn-off material 52. The foregoing steps are repeated multiple times, after which the first burn-off material 51 and the second burn-off material 52 are burned off through firing. The laminated coil component 1 illustrated in FIG. 3 is manufactured through this.

Accordingly, the parts corresponding to the first burn-off material 51 and the second burn-off material 52 serve as the hollow cavity portion 40. In other words, the hollow cavity portion 40 is formed between the first surface 23*a* and both side surfaces 23*c* and 23*c* of the coil conductor 23 and the second and third magnetic layers 112 and 113. The hollow cavity portion 40 has the first extended portion 41, extending outward in the width direction, on the first surface 23*a* side, at both end sides in the width direction. The first burn-off material 51 extends outward in the width direction at the second surface 23*b* of the coil conductor 23, and those extended parts correspond to the second extended portion 42. Additionally, the second burn-off material 52 is formed between the second and third magnetic layers 112 and 113, and extends outward in the width direction at the first surface 23*a* of the coil conductor 23. Those extended parts correspond to the first extended portion 41.

Additionally, the first burn-off material 51 and the second burn-off material 52 are laminated, and thus the second burn-off material 52 enters into the fissures 51*a* in the first burn-off material 51. As such, in the subsequent step of laminating the third magnetic layer 113, the third magnetic layer 113 can be prevented from entering into the fissures 51*a* in the first burn-off material 51. A situation where the coil conductor 23 and the third magnetic layer 113 make contact can thus be avoided, and the occurrence of stress at the boundary between the coil conductor 23 and the third magnetic layer 113 can be suppressed.

Figure 7:
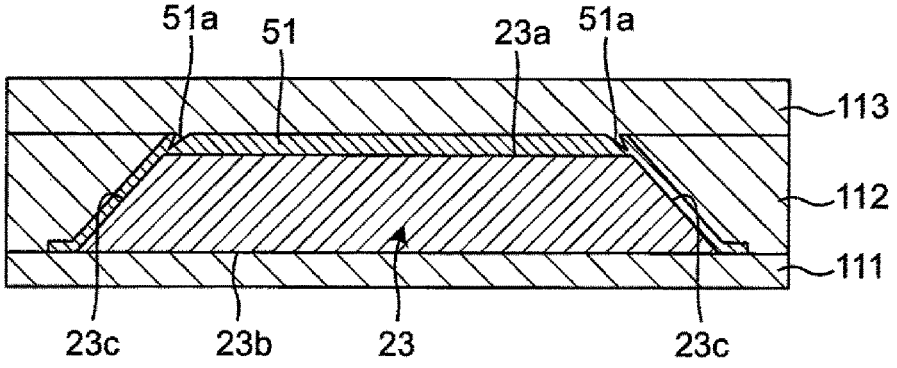
FIG. 7 is a descriptive diagram illustrating a comparative example of a method of manufacturing the laminated coil component.

However, if the second burn-off material 52 is not provided, the third magnetic layer 113 will enter into the fissures 51*a* in the first burn-off material 51 in the subsequent step of laminating the third magnetic layer 113, as illustrated in FIG. 7. The coil conductor 23 and the third magnetic layer 113 will make contact as a result, and stress on the third magnetic layer 113 will arise due to temperature changes in the coil conductor 23. As a result, inductance and impedance characteristics will deteriorate due to internal stress.

Note that the first to third magnetic layers 111 to 113, the first and second burn-off materials 51 and 52, and the coil conductors 23 may be formed by printing and drying pastes, or may be formed by pressure-bonding sheets. To make it easier to form the hollow cavity portion 40, a shrinkage rate of a conductive paste used for the coil conductors is preferably greater than a shrinkage rate of a magnetic paste used for the magnetic layers. Additionally, to make it easier to form the hollow cavity portion 40, a shrinkage starting temperature of the conductive paste used for the coil conductors is preferably lower than a shrinkage starting temperature of a magnetic paste used for the magnetic layers.

Additionally, the side surfaces 23*c* of the coil conductor 23 are preferably slanted. According to this configuration, of the main portion 43 of the hollow cavity portion 40, the hollow cavity that makes contact with the side surfaces 23*c* of the coil conductor 23 (including the second extended portion 42) can be formed in a stable manner. To describe this in detail, when the first burn-off material 51 is laminated onto the coil conductor 23 as illustrated in FIG. 6A, the first burn-off material 51 can be formed on the side surfaces 23*c* of the coil conductor 23 in a stable manner. As a result, the parts of the hollow cavity that make contact with the side surfaces 23*c* of the coil conductor 23 (including the second extended portion 42) can be formed reliably.

Note that like the coil conductor 23 (the line portion 28), the first and second extended conductors 21 and 22 may have the hollow cavity portion 40 present between one surface side thereof in the lamination direction and both side surfaces thereof and the magnetic layer 11, and another side in the lamination direction may make contact with the magnetic layer 11.

However, the first and second extended conductors 21 and 22 are exposed from the end surfaces of the element housing 10, and there is thus a risk of moisture, plating liquid, or corrosive gas entering from these parts. If moisture enters into the hollow cavity portion 40, it becomes easier for the materials of the coil conductor 23 or the first and second extended conductors 21 and 22 (silver, for example) to undergo electrochemical migration. Meanwhile, if plating liquid or corrosive gas enters, there is a risk that the coil conductor 23 or the first and second extended conductors 21 and 22 will undergo gas corrosion. In light of this, a structure in which the hollow cavity portion 40 is not provided in the extended conductors 21 and 22 is more preferable.

As a structure in which the hollow cavity portion 40 is not provided in the extended conductors 21 and 22, a structure in which the coil conductor 23 (the line portion 28) and the first and second extended conductors 21 and 22 are provided on different magnetic layers 11 is preferable. In this case, the manufacturing process can be made simpler as compared to the laminated coil component according to the first embodiment (a case where the coil conductor 23 (the line portion 28) and the extended conductor 22 are formed on the same magnetic layer 11, as illustrated in FIG. 2).

Second Embodiment

Figure 8:
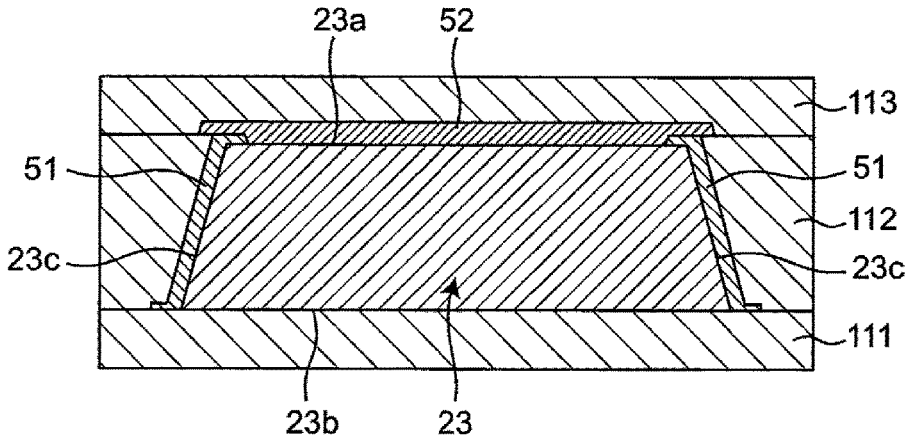
FIG. 8 is a descriptive diagram illustrating a second embodiment of a method of manufacturing the laminated coil component.

FIG. 8 is a cross-sectional view of a second embodiment of a method of manufacturing a laminated coil component according to the present disclosure. The second embodiment differs from the first embodiment in terms of the location where the first burn-off material is provided. This difference will be described hereinafter. Note that in the second embodiment, reference numerals identical to those used in the first embodiment indicate identical configurations as in the first embodiment, and thus descriptions thereof will be omitted.

FIG. 8 corresponds to FIG. 6E described in the first embodiment. The second embodiment illustrated in FIG. 8 has the same sequence of steps as in the first embodiment (FIGS. 6A to 6E). However, in the step of laminating the first burn-off material 51, indicated in FIG. 6A described in the first embodiment, the first burn-off material 51 is laminated on part of the first surface 23*a*, which corresponds to the upper surface of the coil conductor 23, and the side surfaces 23*c* and 23*c* on both sides of the coil conductor 23 in the width direction thereof.

To describe in more detail, on one side in the width direction, one first burn-off material 51 is provided on one side surface 23*c* and a peripheral edge portion on the one side surface 23*c* side of the first surface 23*a*. On another side in the width direction, another first burn-off material 51 is provided on another side surface 23*c* and a peripheral edge portion on the other side surface 23*c* side of the first surface 23*a*. In this manner, the first burn-off material 51 is divided into two parts in the width direction. Accordingly, no fissures will arise in the first burn-off material 51 even if the second magnetic layer 112 illustrated in FIG. 6C dries and shrinks.

The first burn-off material 51 is provided on the peripheral edge portions of the first surface 23*a*, and is not provided on the entire first surface 23*a*. However, the second burn-off material 52 is also provided on the parts of the first surface 23*a* aside from the peripheral edge portions. As such, the hollow cavity portion 40 can be formed from the first and second burn-off materials 51 and 52.

Third Embodiment

Figure 9:
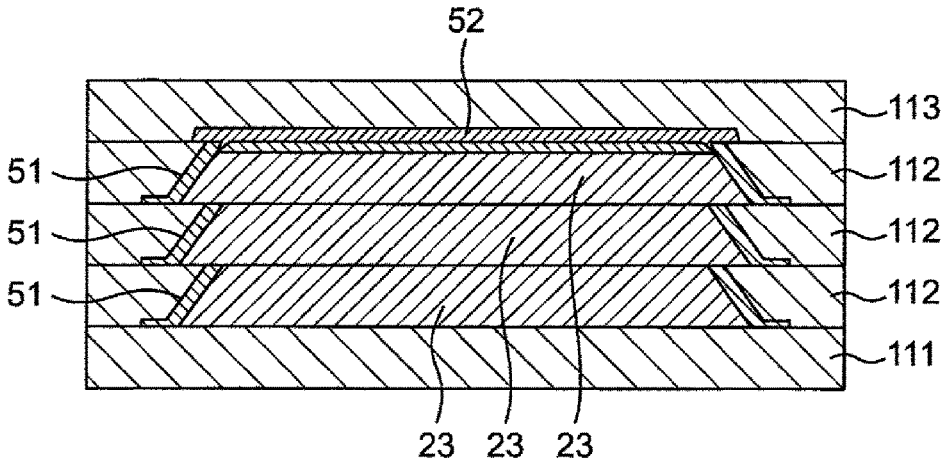
FIG. 9 is a descriptive diagram illustrating a third embodiment of a method of manufacturing the laminated coil component.

FIG. 9 is a cross-sectional view of a third embodiment of a method of manufacturing a laminated coil component according to the present disclosure. The third embodiment differs from the first embodiment in terms of the number of steps. This difference will be described hereinafter. Note that in the third embodiment, reference numerals identical to those used in the first embodiment indicate identical configurations as in the first embodiment, and thus descriptions thereof will be omitted.

FIG. 9 corresponds to FIG. 6E described in the first embodiment. In the third embodiment illustrated in FIG. 9, a step of laminating the coil conductor 23 (described in the first embodiment), a step of laminating the first burn-off material 51 (described in the first embodiment), and a step of laminating the second magnetic layer 112 (described in the first embodiment) are repeated multiple times in order. These steps are repeated three times in this embodiment. The second burn-off material 52 (described in the first embodiment) is then laminated. Then, the third magnetic layer 113 is laminated, and the first and second burn-off materials 51 and 52 are burned off through firing, in the same manner as in the first embodiment.

Assuming the step of laminating the coil conductor 23, the step of laminating the first burn-off material 51, and the step of laminating the second magnetic layer 112 are repeated in order N times (where N is an integer greater than or equal to 2), preferably, in the step of laminating the first burn-off material 51, the first burn-off material 51 is laminated on both side surfaces of the first to the (N−1)th coil conductors 23 that are laminated, and the first burn-off material 51 is laminated on at least part of the first surface and both side surfaces of the Nth coil conductor 23 that is laminated. As a result, the plurality of coil conductors 23 that are laminated together can be electrically connected to each other.

According to the third embodiment, the step of laminating the coil conductor 23, the step of laminating the first burn-off material 51, and the step of laminating the second magnetic layer 112 are repeated multiple times, and thus thick-film coil conductors 23 can be formed.

Fourth Embodiment

Figure 10:
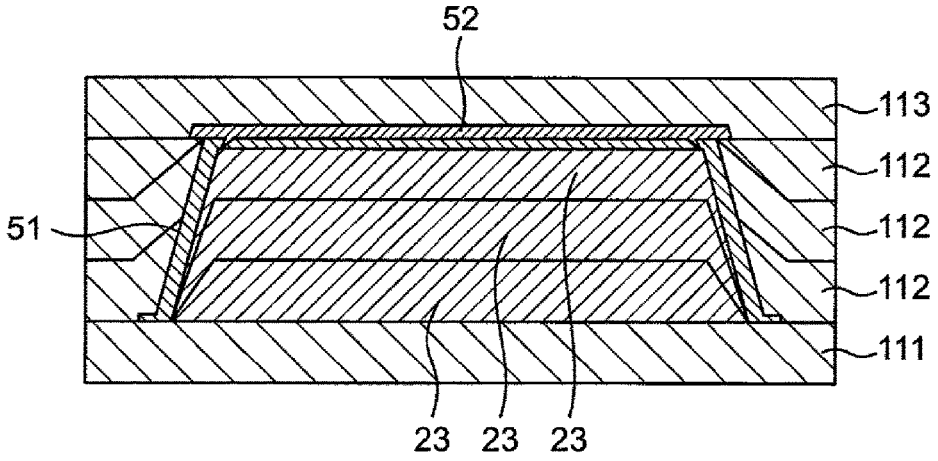
FIG. 10 is a descriptive diagram illustrating a fourth embodiment of a method of manufacturing the laminated coil component.

FIG. 10 is a cross-sectional view of a fourth embodiment of a method of manufacturing a laminated coil component according to the present disclosure. The fourth embodiment differs from the first embodiment in terms of the number of steps. This difference will be described hereinafter. Note that in the fourth embodiment, reference numerals identical to those used in the first embodiment indicate identical configurations as in the first embodiment, and thus descriptions thereof will be omitted.

FIG. 10 corresponds to FIG. 6E described in the first embodiment. In the fourth embodiment illustrated in FIG. 10, the step of laminating the coil conductor 23 (described in the first embodiment) is carried out once or repeated multiple times. This step is repeated three times in this embodiment. Then, the step of laminating the first burn-off material 51 (described in the first embodiment) is carried out, and the step of laminating the second magnetic layer 112 (described in the first embodiment) is carried out once or repeated multiple times. This step is repeated three times in this embodiment. The second burn-off material 52 (described in the first embodiment) is then laminated. Then, the third magnetic layer 113 is laminated, and the first and second burn-off materials 51 and 52 are burned off through firing, in the same manner as in the first embodiment.

Note that the number of times the step of laminating the coil conductor 23 is repeated and the number of times the step of laminating the second magnetic layer 112 is repeated may be the same or may be different.

According to the fourth embodiment, the step of laminating the coil conductor 23 is carried out once or repeated multiple times, and the step of laminating the first burn-off material 51 is then carried out. Then, the step of laminating the second magnetic layer 112 is carried out once or repeated multiple times. Accordingly, thick-film coil conductors 23 can be formed.

Additionally, compared to the third embodiment, the step of laminating the first burn-off material 51 can be carried out only once, which makes it possible to reduce costs.

Note that the present disclosure is not limited to the above-described embodiments, and many design changes are possible without departing from the essential spirit of the present disclosure. For example, the characteristic points of the first to fourth embodiments may be combined in a variety of ways.

In the above-described embodiments, the first extended portion is provided on the first surface side, on both end sides in the width direction. However, it is sufficient for the first extended portion to be provided on the first surface side on at least one end side in the width direction. Doing so makes it possible to block small-loop magnetic fluxes.

In the above-described embodiments, the second extended portion is provided on the second surface side, on both end sides in the width direction. However, it is sufficient for the second extended portion to be provided on the second surface side on at least one end side in the width direction. Doing so makes it possible to block small-loop magnetic fluxes.

In the above-described embodiments, both the first extended portion and the second extended portion are provided. However, of the first extended portion and the second extended portion, it is sufficient for at least the first extended portion to be provided. Doing so makes it possible to block small-loop magnetic fluxes.

In the above-described embodiments, the base end and the leading end of the first extended portion are located further inward than the maximum width of the coil conductor. However, the base end of the first extended portion may be located further inward than the maximum width of the coil conductor, and the leading end of the first extended portion may be located further outward than the maximum width of the coil conductor. A situation where the first extended portion expands outward in the width direction of the coil conductor can therefore be reduced. Accordingly, a situation where the large-loop magnetic flux is blocked by the first extended portion can be reduced.

In the above-described embodiments, the cross-sectional shape of the coil conductor in the width direction is a substantially trapezoidal shape. However, the cross-sectional shape may be substantially rectangular, a substantially flat semi-ellipse, or the like. When the cross-sectional shape of the coil conductor is substantially rectangular, the base end of the first extended portion may be located further outward than the maximum width of the coil conductor.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A laminated coil component comprising a plurality of magnetic layers and a plurality of coil conductors laminated in a lamination direction, wherein in a cross-section taken along a width direction of the coil conductors, each of the coil conductors having a first surface on one side in the lamination direction, a second surface on another side in the lamination direction, and side surfaces on both sides in the width direction;

the second surface making contact with the magnetic layer;

a hollow cavity portion being formed between the magnetic layer, and the first surface and both the side surfaces; and the hollow cavity portion having a first extended portion, extending outward in a direction intersecting with the lamination direction, on the first surface side, on at least one of both end sides in the width direction.

2. The laminated coil component according to claim 1, wherein in the cross-section taken along the width direction of the coil conductor, a base end of the first extended portion is located further inward than a maximum width of the coil conductor.

3. The laminated coil component according to claim 2, wherein in the cross-section taken along the width direction of the coil conductor, a leading end of the first extended portion is located further inward than a maximum width of the coil conductor.

4. The laminated coil component according to claim 1, wherein in the cross-section taken along the width direction of the coil conductor, the first extended portion is located on the first surface side, on both end sides in the width direction.

5. The laminated coil component according to claim 1, wherein in the cross-section taken along the width direction of the coil conductor, the hollow cavity portion has a second extended portion, extending outward in a direction intersecting with the lamination direction, on the second surface side, on at least one of both end sides in the width direction.

6. The laminated coil component according to claim 5, wherein in the cross-section taken along the width direction of the coil conductor, the second extended portion is located on the second surface side, on both end sides in the width direction.

* * * * *